US005445367A

United States Patent [19]

Long

[11] Patent Number: 5,445,367

[45] Date of Patent: Aug. 29, 1995

[54] SYSTEM AND METHOD FOR PREPARING LETTERS FOR MAILING

[76] Inventor: John A. Long, 41 Lamont Avenue, Scarborough, Ontario, Canada, M1S 1A8

[21] Appl. No.: 47,285

[22] Filed: Apr. 19, 1993

[51] Int. Cl.[6] ..... B65B 61/20; B65B 61/02; B65H 39/14

[52] U.S. Cl. ..... 270/1.1; 270/58; 53/50; 53/411; 53/131.5; 53/284.3; 53/460; 364/478

[58] Field of Search ..... 270/52, 52.5, 58, 32, 270/45, 51, 59; 364/478; 235/380; 53/131.5, 284.3, 460, 50, 569, 411; 493/216

[56] References Cited

U.S. PATENT DOCUMENTS

| | | | |
|---|---|---|---|
| 3,902,655 | 9/1975 | Huffman . | |
| 3,983,679 | 10/1976 | Zemke | 53/284.3 X |
| 4,283,048 | 8/1981 | Muller . | |
| 4,384,196 | 5/1983 | McCumber et al. | 270/58 X |
| 4,429,217 | 1/1984 | Hill et al. | 270/52 X |
| 4,639,873 | 1/1987 | Baggarly et al. | 270/58 X |
| 4,644,731 | 2/1987 | Zangheri | 53/284.3 X |
| 4,784,379 | 11/1988 | Vander Syde et al. | 270/58 X |
| 4,797,832 | 1/1989 | Axelrod et al. . | |
| 4,800,505 | 1/1989 | Axelrod et al. | 270/1.1 X |
| 4,972,655 | 11/1990 | Ogawa | 270/58 X |
| 5,012,073 | 4/1991 | Hewitt et al. | 235/380 X |
| 5,283,752 | 2/1994 | Gombault et al. | 270/58 X |
| 5,388,815 | 2/1995 | Hill et al. | 270/58 X |

FOREIGN PATENT DOCUMENTS

| | | |
|---|---|---|
| 2945386 | 6/1986 | Germany . |
| WO91-12903 | 9/1991 | WIPO . |

*Primary Examiner*—John E. Ryznic

[57] ABSTRACT

A system reads a data record from a card and, based on this information, searches a database for additional letter data and prints on a section of a travelling web of paper the data record and letter data. The printed web section is tracked and the card providing the data record is affixed to the web section. The printed web section with card is then separated to form a letter sheet and inserts are selected for the letter sheet with card based on the previously read data record for the card. The letter sheet with card and selected inserts is then stuffed into an envelope and an indication of the weight of the envelope with enclosures, based on the known weight of the envelope, card and letter sheet and the known weights of the selected inserts, is provided to a franking machine.

19 Claims, 3 Drawing Sheets

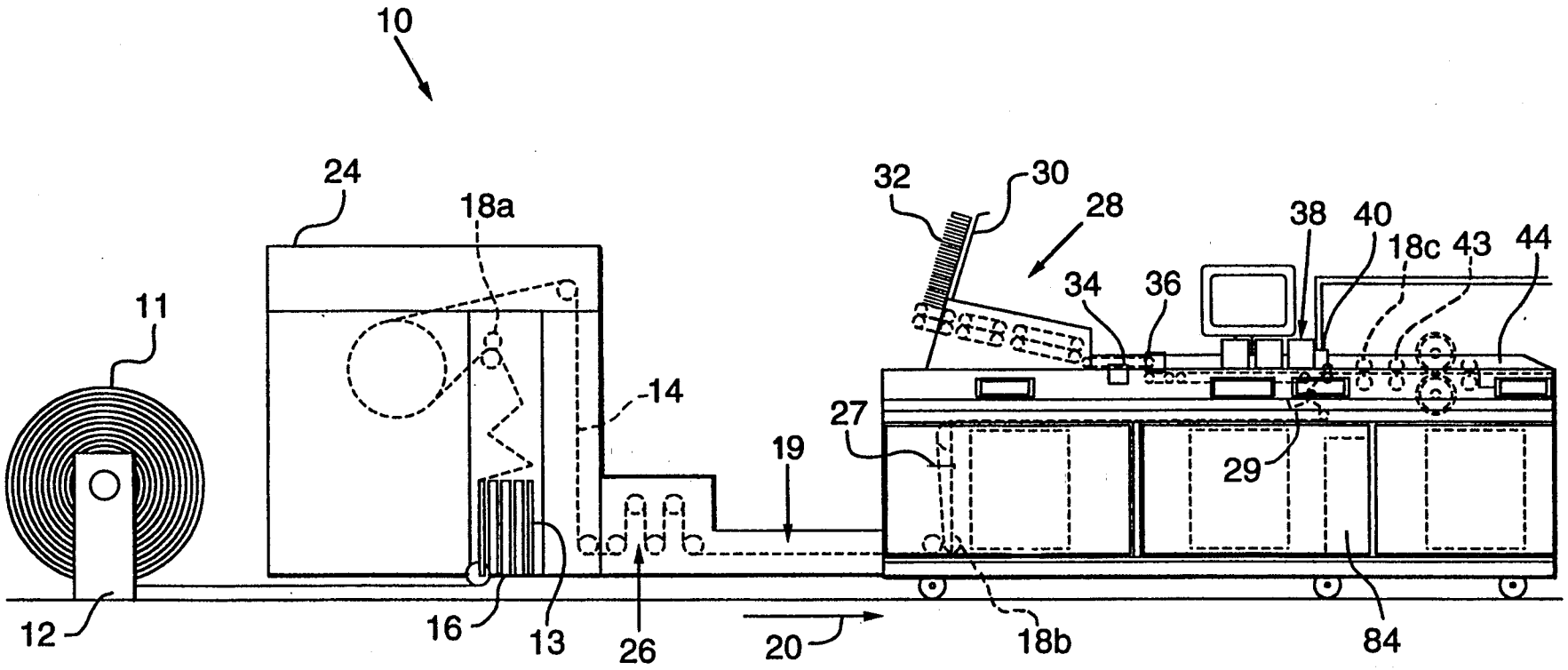
FIG.1.a

SYSTEM AND METHOD FOR PREPARING LETTERS FOR MAILING

BACKGROUND OF THE INVENTION

1. Field of the Invention

This invention relates to a system and a method for preparing letters for mailing.

2. Description of the Related Art

A number of machines exist for automating port ions of the task of preparing letters for mass mailings and target mailings. It is recognized that the response to a mass mailing is on the order of two percent. Conversely, the response for target mailings is on the order of twenty-four percent. Accordingly, it would be desirable to provide a high speed system for preparing letters for the mails which would be particularly adapted for target mailings.

SUMMARY OF THE INVENTION

According to the present invention, there is provided a system for preparing letters for mailing comprising the following: a source of data records comprising a plurality of data cards, each having a data record; means for conveying a web of paper in a downstream direction along a first path; a high speed printer in said first path for printing upon said web; control means responsive to said data records source for, repetitively, reading a data record from a card of said plurality of data cards and, responsive to said read data record, controlling said printer to print on a section of said web; a separator at the downstream end of said first path for separating a letter sheet from each printed section of said web of paper; a letter sheet conveyor for conveying letter sheets separated by said separator in a downstream direction along a second path; a plurality of insert feeders adjacent said second path, each for feeding inserts to letter sheets travelling along said second path; means for, repetitively, tracking a web section printed in accordance with a given data record and the resulting letter sheet and selectively activating said insert feeders in accordance with said given data record when said resulting letter sheet is at said insert feeders; an envelope conveyor for conveying envelopes in a downstream direction along a third path merging with said second path downstream of said insert feeders such that letter sheets with inserts conveyed along said second path are stuffed into envelopes conveyed along said third path; means for feeding said data cards in a downstream direction along a fourth path merging with said first path such that each data card is inserted onto one said section of said web; and said control means comprising a card reader means in said fourth path and timing means so that a given data card is inserted onto a section of said web which is printed in response to data read from said given data card.

According to another aspect of the invention, there is provided a method for preparing letters for mailing comprising the following steps: reading consecutive data cards, each having a data record; conveying a web of paper in a downstream direction along a first path; printing upon consecutive sections of said web responsive to consecutive data records read from said cards; timing and affixing said data cards to said web so that a section of said web printed in response to data read from a given data card is the section of the web to which said given data card is affixed; separating letter sheets from each section of said web of paper conveyed along said first path; conveying separated letter sheets in a downstream direction along a second path; tracking the progress of a given section of the web and the resulting letter sheet separated from said given section of the web and feeding selected inserts to said resulting letter sheet in response to the data record utilised in printing said given section of the web; conveying envelopes in affixing said data cards to said web so that a section of said web printed in response to data read from a given data card is the section of the web to which said given data card is affixed; separating letter sheets from each section of said web of paper conveyed along said first path; conveying separated letter sheets in a downstream direction along a second path; tracking the progress of a given section of the web and the resulting letter sheet separated from said given section of the web and feeding selected inserts to said resulting letter sheet in response to the data record utilised in printing said given section of the web; conveying envelopes in a downstream direction along a third path and merging said second path with said third path such that letter sheets with inserts conveyed along said second path are stuffed into envelopes conveyed along said third path.

BRIEF DESCRIPTION OF THE DRAWINGS

In the figures which disclose example embodiments of the invention,

FIGS. 1*a* and 1*b* comprise a schematic side view of the system made in accordance with this invention.

DESCRIPTION OF PREFERRED EMBODIMENTS

Figure 1B:
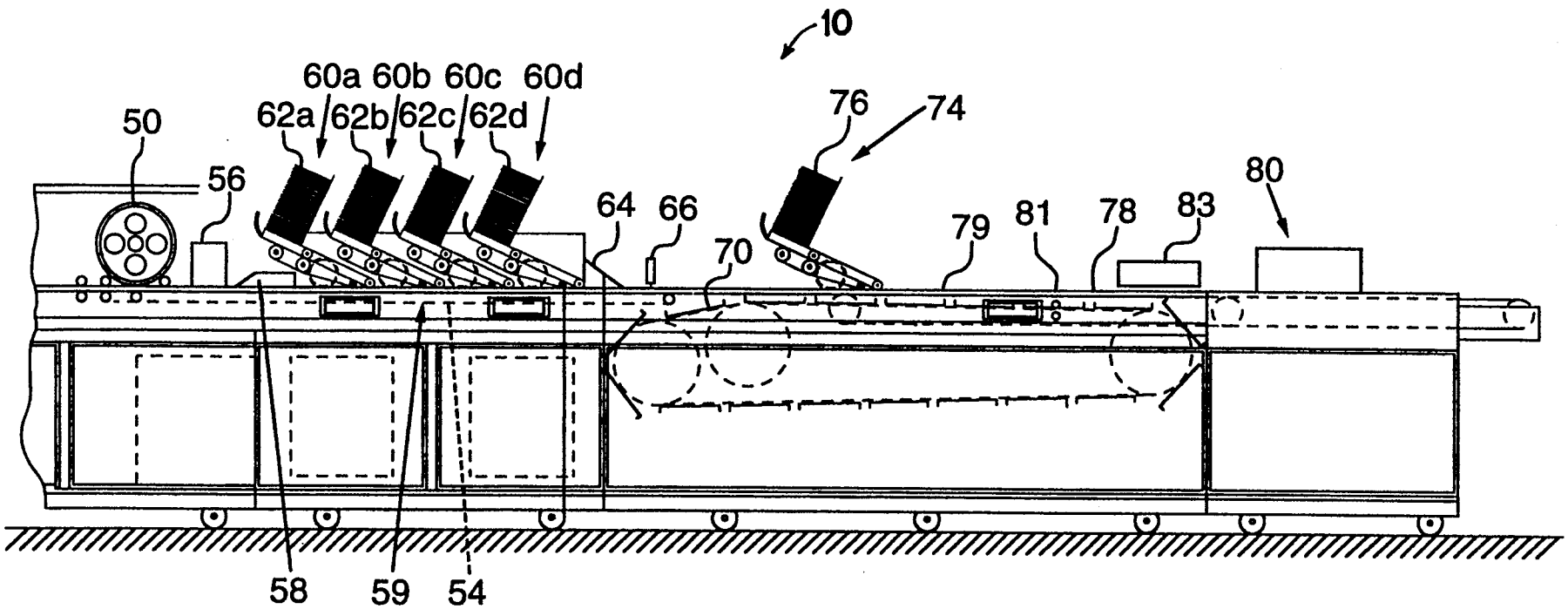
Figure 2:
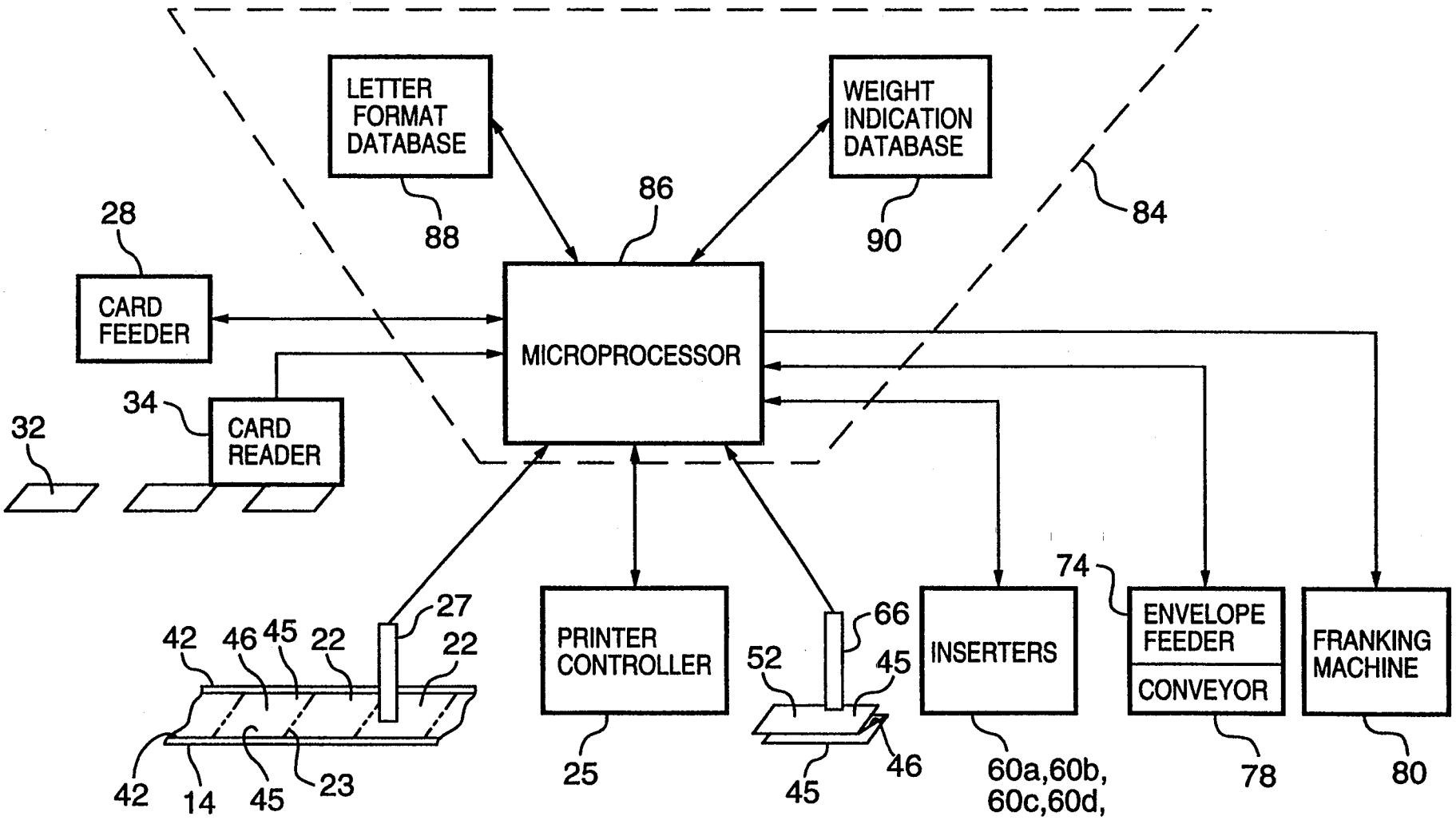
FIG. 2 is a schematic block diagram of the control components for the system of FIGS. 1*a* and 1*b*.

With reference to FIGS. 1*a* and 1*b*, a system 10 for preparing letters for mailing comprises a reservoir 12 for a rolled web of paper 11 and a second reservoir 16 for a fan folded web of paper 13. As seen in FIG. 2, the web of paper 14 comprises a plurality of sections 22 delineated by transverse cut/perforation lines 23. Driving strips 42 are provided on either side of the web. The cut/perforation lines 23 divide the web interiorly of the driving strips into marginal portions 45 and medial portion 46. Such a form is further described in U.S. Pat. No. 5,219,631 issued Jun. 15, 1993, the disclosure of which is incorporated by reference.

A number of feed rollers 18*a*, 18*b*, 18*c* are provided to drive the web of paper 14 along a path 19 in a downstream direction 20 from one of the reservoirs. A high speed laser printer 24 is provided in path 19 of the web 14. Path 19 then passes around a number of dancer rollers 26, past a web section sensor 27, past an adhesive nozzle 29 and to a merging station 40.

A card feeder 28 is positioned above web path 19. The card feeder has a hopper 30 with a stack of data cards 32. Each card 32 stores a data record on a magnetic strip or other data storage medium. The card may be a credit card, driver's licence or other information storing card. The card feeder 28 feeds cards 32 in a downstream direction through card reader 34 and card buffer 36. Card buffer 36 is a FIFO stack of data cards which effectively lengthens the card feeder 28 and therefore slows the progress of cards through the card feeder. From buffer 36, the card feeder feeds the cards past three card diverters 38 to the merging station 40 whereat the path for cards 32 merges with path 19. It is noted that the merging station 40 is just downstream of adhesive nozzle 29 associated with path 19.

Downstream of merging station 40, a stripper 43 strips the drive strips from the web 14, further downstream folding plows 44 are provided to Z-fold the marginal portions 42 of a web section 22 about the medial web portion 46 (see FIG. 2). Downstream of the folding plows, a separator 50 bursts folded letter sheets (seen at 52 in FIG. 2) with affixed cards from consecutive sections 22 of web 14. The letter sheets are then conveyed along a path 59 by letter sheet lug conveyor 54 in downstream direction 20. A letter sheet diverter 56 is provided proximate the upstream end of letter sheet conveyor 54. Downstream from diverter 56 is an unfolding plow 58 for unfolding one margin 45 of the folded letter sheet 52 (seen in FIG. 2). Downstream of the unfolding plow 58 is a series of insert feeders 60*a*, 60*b*, 60*c*, 60*d* for feeding selected inserts 62*a*, 62*b*, 62*c*, 62*d* to the letter sheet conveyor 54. Path 59 subsequently passes through a folding plow 64. A letter sheet sensor 66 is associated with the conveyor 54 downstream of the folding plow 64.

A stuffing conveyor 70 is positioned at the downstream end of letter sheet conveyor 54 and continues path 59. An envelope feeder 74 feeds envelopes 76 along an envelope conveying path 79 defined by conveyor 78. The stuffing conveyor 70 feeds the letter sheets with affixed cards and inserts to a merging station 81 whereat path 59 merges with path 79; the envelopes are opened at the merging station 81 so that letter sheets with affixed cards and inserts are stuffed into envelopes. A suitable machine to merge inserts into envelopes is described in U.S. patent application Ser. No. 07/946,903, the contents of which are incorporated by reference.

An envelope sealing station 83 and a franking machine 80 are positioned along conveyor 78 downstream of merging station 81. A system computer 84 is operatively associated with various components of the system, as shown in FIG. 2.

Turning to FIG. 2, the system computer 84 comprises a microprocessor 86 which is connected for a two-way communication with a letter format database 88, a weight indication database 90 and with printer controller 25 of printer 24. The microprocessor is connected to the drive for card feeder 28, insert feeders 60*a*, 60*b*, 60*c*, and 60*d*, envelope feeder 74 and conveyor 78 and receives back a speed signal from each (which may, for example, come from a rotary encoder associated with each). The letter format database stores different letter formats, for example, different texts for the body of a letter. The letter format may have a number of blanks in it for insertion of information. The weight indication database stores an indication of the weight of a letter sheet 52, a data card 32, an envelope 76, and each of the inserts 62*a*, 62*b*, 62*c*, 62*d*.The microprocessor receives an input from card reader 34, web section sensor 27, and letter sheet sensor 66. The microprocessor outputs to franking machine 80.

In operation, card feeder 28 feeds consecutive cards 32 to card reader 34 under control of the microprocessor 86. When a card passes under card reader 34, the reader reads a data record therefrom. This data record is passed to the microprocessor. Web 14 is conveyed along path 19 in downstream direction 20 by drive rollers 18*a*, 18*b*, 18*c*. The microprocessor selects a letter format from the letter format database 88 based on information in the data record read from a data card. The microprocessor 86 passes this information along with selected other information in the data record to printer controller 25. The printer controller controls the printer to print this information on one section 22 of web 14 such that lines of text are printed transversely of the downstream direction 20 of the web. The controller passes a signal to the microprocessor when this printing operation has been completed. Based on feedback from the printer controller and the speed of the web derived from signals from web section sensor 27, the microprocessor tracks the progress of the printed web section 22. The microprocessor 86 controls the speed of card feeder 28 such that a given card read by card reader 34 passes through card buffer 36 (which temporarily detains the card) and merges with path 19 of web 14 just as the web section 22 which was printed with information in the data record read from the given card reaches this point of merging. Just upstream of this merging point, adhesive nozzle 29 applies adhesive to the printed web section such that the merged card is affixed to the web section.

The printed web section 22 with its adhered card proceeds downstream through folding plows 44 which fold marginal portions 45 of the web section about medial portion 46. The folded printed web section then passes through rotary burster 50 which bursts the section from the web resulting in a folded printed letter sheet 52 with affixed card. The microprocessor continues to track the progress of the printed web section from the merging station 40 to the burster 50 and the microprocessor also tracks the progress of the resulting folded letter sheet 52 utilizing letter sheet sensor 66. Downstream of burster 50, the folded letter sheet 52 passes diverter 56 to unfolding plow 58 which unfolds one margin 45 of the folded letter sheet. The partially unfolded letter sheet then passes under the insert feeders 60*a* through 60*d*. Because the microprocessor has tracked the letter sheet from its precursor web section in printer 25, the microprocessor continues to be aware of the data record which was used to print this web section (and is stored on the card now affixed to this letter sheet). Based on information in this data record, the microprocessor 86 selectively activates one or more of the insert feeders in order to feed selected ones of inserts 62*a*, 62*b*, 62*c*, and 62*d* to the uncovered middle portion 46 of the letter sheet. The letter sheet with inserts then passes to folding plow 64 which again completes the fold of the letter sheet.

The letter sheet with inserts is picked up by conveyor 70. Conveyor 70 is synchronized with conveyor 54 such that the microprocessor 86 is able to continue to track each letter sheet with affixed data card and inserts. Envelope conveyor 74 conveys envelopes on conveyor 78 along path 79 under control of the microprocessor; a letter sheet with card and inserts is conveyed by conveyor 70 on a path 59 which merges with path 79 at merging station 81 so that the letter sheet with inserts and card is stuffed into an envelope. The stuffed envelope is then sealed at sealing station 83 and then passes to franking machine 80.

As aforenoted, the microprocessor 86 utilizes a data record of a card to determine which inserts to feed to the letter sheet printed in accordance with that data record. The microprocessor uses the identification of the inserts to feed to a particular letter sheet to determine the weight of an envelope stuffed with such inserts along with a card and a letter sheet. Because the microprocessor tracks the progress of any given letter sheet with card and inserts on conveyor 70 and because the microprocessor controls the envelope feeder 76 and conveyor 78, the microprocessor is able to indicate the weight of a stuffed envelope to the franking machine so that proper postage may be printed on the envelope.

Diverters 38 are provided to divert a card 32 where there is some error in reading the card. Where a card is diverted, there is a web section 22 associated with the card which is now superfluous. The microprocessor 86 tracks this superfluous web section through to rotary burster 50 and diverts the resulting letter sheet at diverter 56.

Based on the foregoing description, it will be apparent that information read from a data card is used to print a section of web to which the card is later affixed. Then, when this web section is separated off to form a letter sheet, the information from the card is used to select inserts to be combined with the letter sheet and is also used to indicate the weight of an envelope stuffed with the letter sheet, card, and inserts to a franking machine.

For example, a credit card may provide a data record which identifies a person, their address, and an interest, such as scuba diving. With this information, the computer may select a letter format which provides information of interest to scuba divers. This letter format may then be combined with the name and address of the individual from the data record for printing on a section of the web to which the card will be affixed. Knowing the person is interested in scuba diving will allow the microprocessor to determine which inserts should be associated with the letter sheet and this, in turn, will indicate the weight of the envelope stuffed with this material. Furthermore, credit cards for scuba divers may be indiscriminately mixed with credit cards for golfers, hunters and others and the system of this invention will pick a letter format and inserts for each person based on their particular indicated interest.

By way of further example, the card to be mailed may be a driver's licence in which case the data record, in addition to providing the name and address of an individual, may also indicate whether the card is a first time card, a temporary card, a renewal card, and the number of years of currency of the card. This information, again, may be used to select an appropriate letter format and appropriate inserts. And again, the types of licences may be mixed: for example, first-time licences may be indiscriminantly mixed with renewal licences. With this use of the system, a further database may be provided to indicate the current driving record of an individual identified in the data record. This driving record may be used to modify the chosen letter format and inserts. In the result, a high speed target mailing system may be provided.

The system has application where the source of data records is from a database rather than from data cards 32. That is, data records may be supplied consecutively from a database. With this modification, card feeder 28 with card reader 34, buffer 36 and diverters 38 as well as adhesive nozzle 29 would be unnecessary. Operation would proceed as before, however, there would be no card affixed to the web section. Tracking the web sections and resulting letter sheets through this system would still be necessary in order to ensure that inserts were selected for a letter sheet from the same data record used to print the letter sheet.

Other modifications will be apparent to those skilled in the art and, therefore, the invention is defined in the claims.

What is claimed is:

1. A system for preparing letters for mailing comprising the following:

a letter data database;

a source of data records comprising a plurality of data cards, each having a data record;

means for conveying a web of paper in a downstream direction along a first path;

a high speed printer in said first path for printing upon said web;

control means operatively connected to said letter data database and responsive to said data records source for, repetitively, reading a data record from a card of said plurality of data cards and, responsive to said read data record, reading data from said letter data database and, responsive to said read data record and read data from said letter data database, controlling said printer to print on a section of said web;

a separator at the downstream end of said first path for separating a letter sheet from each printed section of said web of paper;

a letter sheet conveyor for conveying letter sheets separated by said separator in a downstream direction along a second path;

a plurality of insert feeders adjacent said second path, each for feeding inserts to letter sheets travelling along said second path;

means for, repetitively, tracking a web section printed in accordance with a given data record and the resulting letter sheet and selectively activating said insert feeders in accordance with said given data record when said resulting letter sheet is at said insert feeders;

an envelope conveyor for conveying envelopes in a downstream direction along a third path merging with said second path downstream of said insert feeders such that letter sheets with insert s conveyed along said second path are stuffed into envelopes conveyed along said third path;

a card feeder arranged to feed said data cards in a downstream direction along a fourth path merging with said first path such that each data card is inserted onto one said section of said web; and said control means comprising a card reader in said fourth path and timing means so that a given data card is inserted onto a section of said web which is printed in response to data read from said given data card.

2. The system of claim 1 including folding plows for folding margins of said web about a middle portion of said web upstream of said separator and further including an unfolding plow for partially unfolding letter sheets separated from said web upstream of said insert feeders and a folding plow for folding said letter sheets downstream of said insert feeders.

3. The system of claim 1 including a franking means on said third path downstream of the point where said third path merges with said second path, a weight indication database for storing an indication of the weight of a letter sheet separated from said web, the weight of an envelope fed by said envelope feeder, and the weight of an insert in each of said plurality of insert feeders, and weight determination means operatively connected to said weight indication database and responsive to said insert feeder activating means and said letter sheet position determination means for determining the weight of a stuffed envelope at said franking means, said franking means responsive to said weight determination means for franking said stuffed envelope.

4. The system of claim 3 wherein said weight indication database is also for storing an indication of the weight of one of said plurality of data cards.

5. The system of claim 4 including means to divert a card from said fourth path where said card reader means is unable to read a data record from said card.

6. The system of claim 5 including means responsive to said web section sensing means and said letter sheet position determination means for tracking a web section which would be merged with a data card but for the data card being diverted and for diverting the letter sheet resulting from said tracked web section downstream of said separator.

7. The system of claim 6 wherein said means to time said fourth path includes a FIFO data card buffer in said fourth path for temporarily holding data cards.

8. The system of claim 1 wherein said means for conveying a web of paper comprises a plurality of feed rollers.

9. The system of claim 8 wherein said control means comprises a processor.

10. The system of claim 9 wherein said means for, repetitively, tracking a web section printed in accordance with a given data record and the resulting letter sheet and selectively activating said insert feeders in accordance with said given data record when said resulting letter sheet is at insert feeders comprise said processor, a web sect ion sensor, and a letter sheet sensor, said web section sensor and said letter sheet sensor being operatively coupled to said processor.

11. The system of claim 10 wherein said controller is operatively connected to said card feeder.

12. A method for preparing letters for mailing comprising the following steps:

storing letter data in a database;

reading consecutive data cards, each having a data record;

retrieving letter data from said letter data database in response to each record read from said data cards;

conveying a web of paper in a downstream direction along a first path;

printing upon consecutive sections of said web responsive to consecutive data records read from said cards and corresponding consecutive retrieved letter data from said letter data database;

timing and affixing said data cards to said web so that a section of said web printed in response to data read from a given data card is the section of the web to which said given data card is affixed;

separating letter sheets from each section of said web of paper conveyed along said first path;

conveying separated letter sheets in a downstream direction along a second path;

tracking the progress of a given section of the web and the resulting letter sheet separated from said given section of the web and feeding selected inserts to said resulting letter sheet in response to the data record utilised in printing said given section of the web;

conveying envelopes in a downstream direction along a third path and merging said second path with said third path such that letter sheets with inserts conveyed along said second path are stuffed into envelopes conveyed along said third path.

13. The method of claim 12 including the steps of folding margins of said web about a middle portion of said web prior to said separation step, partially unfolding letter sheets separated from said web prior to said insert feeding step, and folding said letter sheets after said insert feeding step.

14. The method of claim 12 including the steps of storing an indication of the weight of a letter sheet separated from said web, the weight of an envelope conveyed during said envelope conveying step, and the weight of each insert which may be fed during said insert selection step, determining the weight of an envelope stuffed with a letter sheet with inserts based on the selected inserts fed to a letter sheet and the stored indications of weight and franking said stuffed envelope.

15. The method of claim 14 including the step of storing an indication of the weight of a data card.

16. The method of claim 15 including the step of diverting a card where said step of reading a data record from said card is unsuccessful.

17. The method of claim 16 including the step of tracking a web section to which a data card would be affixed but for the data card being diverted and for diverting the letter sheet resulting from said tracked web section after said letter sheet is separated from said web.

18. The method of claim 17 including the step of temporarily holding data cards prior to affixing ones of said data cards to said web.

19. The method of claim 18 wherein the step of printing comprises printing text transversely of said downstream direction.

* * * * *

UNITED STATES PATENT AND TRADEMARK OFFICE

CERTIFICATE OF CORRECTION

PATENT NO. : 5,445,367

DATED : August 29, 1995

INVENTOR(S) : John A. Long

It is certified that error appears in the above-identified patent and that said Letters Patent is hereby corrected as shown below:

Column 6, line 41, delete "insert s" and insert --inserts--.

Column 7, line 33, add --said-- between the words "at" and "insert".

Column 7, line 34, delete "sect.ion" and insert --section".

Signed and Sealed this

Second Day of January, 1996

Bruce Lehman

*Attest:*

BRUCE LEHMAN

*Attesting Officer*

*Commissioner of Patents and Trademarks*